US005956976A

United States Patent [19]

Schaffer et al.

[11] Patent Number: 5,956,976

[45] Date of Patent: Sep. 28, 1999

[54] LATCH NEEDLE FOR LOOP-FORMING TEXTILE MACHINES

[75] Inventors: Oskar Schaffer, Albstadt; Wolfgang Schmoll, Haigerloch-Owingen; Kurt Wiedenhöfer, Albstadt; Bernhard Schuler, Sonnenbühl-Erpfingen, all of Germany

[73] Assignee: Groz-Beckert AG, Albstadt, Germany

[21] Appl. No.: 09/045,716

[22] Filed: Mar. 23, 1998

[30] Foreign Application Priority Data

Mar. 22, 1997 [DE] Germany ..... 197 12 124

[51] Int. Cl.[6] ..... D04B 35/04

[52] U.S. Cl. ..... 66/121; 66/122; 66/116

[58] Field of Search ..... 66/121, 122, 116

[56] References Cited

U.S. PATENT DOCUMENTS

| | | | |
|---|---|---|---|
| 3,022,651 | 2/1962 | Oberem | 66/122 |
| 3,050,968 | 8/1962 | Masujima . | |
| 4,827,739 | 5/1989 | Goller et al. | 66/121 |

FOREIGN PATENT DOCUMENTS

| | | |
|---|---|---|
| 218817 | 3/1958 | Australia . |
| 1410312 | 4/1958 | Germany . |
| 202681 | 4/1959 | Germany . |
| 1113537 | 9/1961 | Germany . |
| 37 02 019 | 9/1987 | Germany . |
| 33-6679 | 8/1958 | Japan . |
| 49-13944 | 4/1974 | Japan . |
| 315185 | 7/1929 | United Kingdom . |

*Primary Examiner*—John J. Calvert
*Assistant Examiner*—Tejash D Patel
*Attorney, Agent, or Firm*—Venable; Gabor J. Kelemen

[57] ABSTRACT

A latch needle for loop-forming textile machines includes a needle shank having an upper side, a back and a sawslot extending into the needle shank from the upper side and oriented parallel to the shank. A hook is provided at an end of the needle shank. A spring element is disposed in the sawslot and has at least one end supported by the needle shank. A needle latch is supported in the sawslot for pivotal motion about an axis between a closed position in which the needle latch engages, with a frontal end thereof, the hook and a rearward position. The needle latch has a latch shank which includes an upper side and a lower side. In the rearward position the needle latch lies, with the upper side of the latch shank, on the upper side of the needle shank or is situated in the vicinity of the upper side of the needle shank. The latch shank further has an end part formed as a cam engaged by the spring element. The cam includes a component formed of a flat portion and/or a kink edge at the upper side of the latch shank. The component, cooperating with the spring element, determines and maintains the rearward position of the needle latch. The cam has an arcuate cam face adjoining the component and having, from the pivot axis of the needle latch, a radial distance which gradually decreases from the upper side of the latch shank towards its lower side.

8 Claims, 2 Drawing Sheets

LATCH NEEDLE FOR LOOP-FORMING TEXTILE MACHINES

CROSS REFERENCE TO RELATED APPLICATION

This application claims the priority of German Application No. 197 12 124.1 filed Mar. 22, 1997, which is incorporated herein by reference.

BACKGROUND OF THE INVENTION

This invention relates to a latch needle for loop-forming textile machines and is of the type which has a shank provided with a hook at one end and further has an upper side, a back and a sawslot oriented in the length dimension of the shank and extending from the upper shank side. A needle latch, pivotal about a rivet, is disposed in the sawslot and has a latch shank usually having a spoon at one end. The needle latch is pivotal between a closed position in which the latch spoon engages the hook and a rearward position ("standing position") in which the upper side of the latch lies on or is situated in the vicinity of, the upper side of the needle shank. During inward and outward movement of the latch needle during the knitting operation, the needle latch, controlled by the newly-formed loop, conventionally moves between the two positions.

German Patent No. 37 02 019 discloses a latch needle whose needle latch may be held in a partially open, intermediate position by a spring element disposed in the sawslot. By virtue of such an intermediate position of the needle latch, upon the first casting on, that is, when the knitting process begins or upon catching loops, an unimpeded feeding of the yarn into the needle hook is ensured without the necessity to resort to a brush-like needle opener conventionally used in knitting machines or to first open manually all the needle latches which is significantly labor-intensive.

Other embodiments of latch needles provided with a spring element as noted earlier are known from German Patent No. 1,113,537 and U.S. Pat. No. 3,050,968; a basically similar embodiment is known from the Japanese patent publication No. 33-6679. The spring element may be clamped only at one of its two ends as shown in the above-noted German patent No. 37 02 019 or may, at both ends, engage corresponding shoulders in the sawslot as disclosed in the above-noted U.S. Pat. No. 3,050,968. The needle latch is formed as a cam element at that end of the latch shank which is situated in the sawslot. The spring element exerts a force on the cam element at least during a portion of the motion path of the needle latch from the closed position into the rearward position.

In the latch needle disclosed in U.S. Pat. No. 3,050,968, similarly to that described in German Patent No. 1,113,537 (which relates to a latch needle for a manual knitting apparatus), the end part of the latch shank situated in the sawslot is provided with a first flat portion which is situated on the upper side of the latch shank. By virtue of this arrangement, the needle latch is, in cooperation with the spring element, elastically held in a stable intermediate position adjacent the rearward position. In the intermediate position the upper side of the latch shank is situated at a distance from the upper side of the needle shank. A second flat portion in the region of the underside of the latch shank defines, again in cooperation with the spring element, the partially open position of the needle latch in which the latch spoon is at a distance from the needle hook, so that the yarn may be fed into the needle hook. Between the two chamfers the cam element has a "cured" (German Patent No. 1,113,537) or circularly bent surface which is arranged concentrically to the pivot axis of the needle latch (U.S. Pat. No. 3,050,968). In addition, in U.S. Pat. No. 3,050,968 embodiments are described in which the first flat portion defining a stable rearward position of the needle latch is dispensed with.

It is a common characteristic of the known latch needles provided with a spring element for the needle latch that upon outward travel of the needle into the tucking position, the loop which slides over the needle latch when it is in the standing (open) position, pulls the needle latch against the force of the spring element to the upper side of the needle shank. As a result of this occurrence, the needle latch, upon its release by the loop during the further course of the outward motion, snaps upward from its rearward position under the effect of the armed spring element and assumes an intermediate position. In such an intermediate position the needle latch stands off the needle shank, that is, its longitudinal axis forms, with the longitudinal axis of the needle shank, an acute or obtuse angle of random magnitude or of predetermined magnitude by virtue of flat portions on the needle latch.

To prevent the needle latches, held in such mid position, from colliding with the yarn carrier or other machine components and thus risk damaging, in the conventional knitting machines operating with knitting cams, it is known to provide, at the yarn carrier, separate latch openers formed as brushes or devices.

More recently, however, carriage-less flat knitting machines have been developed in which the needles are driven by linear motors. For structural reasons, in such knitting machines external latch operating devices such as brushes or mechanical latch openers (metal skirts, etc.) can be used, if at all, only with a substantial technological outlay.

SUMMARY OF THE INVENTION

It is an object of the invention to provide an improved latch needle which is of the type that has a needle latch cooperating with a spring element and in which structural measures exclude, or at least essentially prevent, an uncontrolled upward snap of the needle latch from the rearward position.

This object and others to become apparent as the specification progresses, are accomplished by the invention, according to which, briefly stated, the latch needle for loop-forming textile machines includes a needle shank having an upper side, a back and a sawslot extending into the needle shank from the upper side and oriented parallel to the shank. A hook is provided at an end of the needle shank. A spring element is disposed in the sawslot and has at least one end supported by the needle shank. A needle latch is supported in the sawslot for pivotal motion about an axis between a closed position in which the needle latch engages, with a frontal end thereof, the hook and a rearward position. The needle latch has a latch shank which includes an upper side and a lower side. In the rearward position the needle latch lies, with the upper side of the latch shank, on the upper side of the needle shank or is situated in the vicinity of the upper side of the needle shank. The latch shank further has an end part formed as a cam engaged by the spring element. The cam includes a component formed of a flat portion and/or a kink edge at the upper side of the latch shank. The component, cooperating with the spring element, determines and maintains the rearward position of the needle latch. The cam has an arcuate cam face adjoining the component and having, from the pivot axis of the needle latch, a radial distance which gradually decreases from the upper side of the latch shank towards its lower side.

Thus, in the needle latch according to the invention the cam element formed at the end portion of the latch shank has a curved cam face, whose radial distance from the latch axis continuously decreases from the upper side of the needle shank to the lower side thereof. The curved cam face adjoins a flat portion determining its rearward position and/or a transversely extending kink edge of the latch shank.

The curved cam face may be essentially of circular curvature in which case the center of curvature is offset relative to the pivotal axis of the needle latch to thus constitute an eccentric face. The center of the curvature is offset towards the upper side of the latch shank. In the alternative, the cam face may be of spiral configuration or may have another continuous course.

The needle latch is maintained in its rearward position by the flat portion and/or the kink edge. When the loop, during the outward motion of the needle, releases the needle latch situated in its rearward position, the needle latch seeks to snap into an undefined mid position under the elastic forces overcoming the resistance of the kink edge, if present. Such a motion of the needle latch is, however, impeded by the spring element which initially lies with a relatively large bias on that part of the cam face which is radially the remotest from the pivot axis and thus exerts a significant frictional braking force on the needle latch. Therefore, the needle latch stops in the immediate vicinity of the rearward position.

When, in the further course of the knitting process, the needle latch, during the immediately following inward motion of the needle, is closed by the loop sliding on the upper surface of the needle shank, the braking force exerted on the cam face increasingly diminishes because the radial distance of the cam face from the pivot axis of the latch continuously decreases, as result of which the bending and thus the bias of the spring element also drops. With an increasing approach to the closed position, the latch thus moves increasingly with more ease, which, among others, is advantageous as concerns wear considerations and which significantly improves the quality of the knit fabric.

A second flat portion provided at the end part of the needle shank determines, in cooperation with the spring element, a partially open position of the needle latch. In such a partially open position the needle latch is held in a stable manner by the elasticity of the spring element until the loop, gliding on the needle latch, moves the latter into its final, closed position in which it lies on the hook with its spoon. As soon as the loop is knocked over, the needle latch is again moved into the partially open position by the spring element.

While the cam face may have a continuous transition into the first flat portion which determines the rearward position of the needle latch, advantageously, the cam face adjoins the first flat portion or a face on the upper surface of the needle shank by a transversely extending kink edge or kink line. The kink edge results in a more accurate definition of the location which the needle latch assumes in its rearward position.

DESCRIPTION OF THE PREFERRED EMBODIMENT

Figure 1:
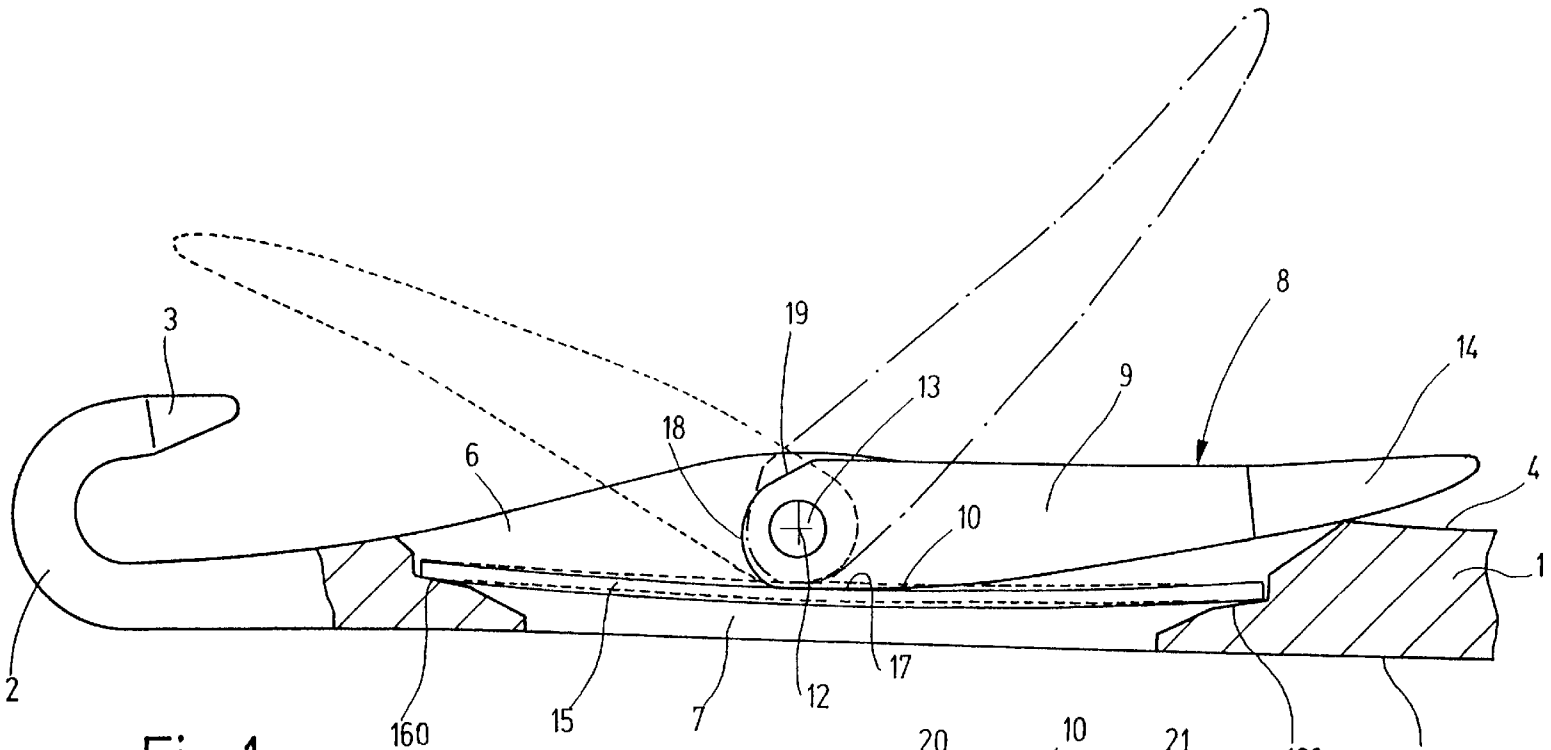
FIG. 1 is a sectional fragmentary side elevational view of a latch needle illustrating, in solid lines, the needle latch in the rearward position.
Figure 3:
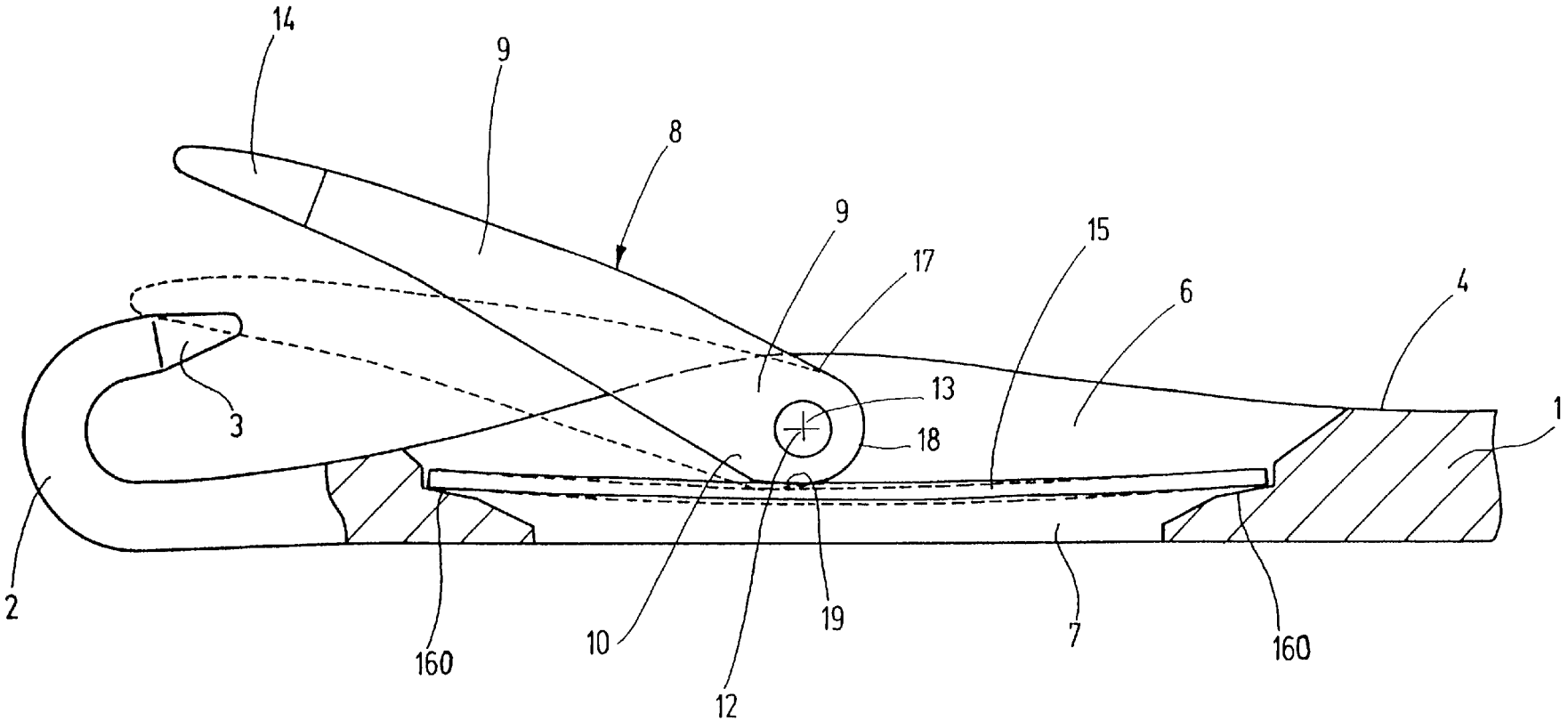
FIG. 3 is a view similar to FIG. 1, illustrating in solid lines, the needle latch in a partially open position.

The latch needle illustrated in FIGS. 1 and 3 has an only partially shown needle shank 1, having an upper side 4, a needle shank back 5 and carrying, at one end, a needle hook 2 provided with a hook tip 3.

In the needle shank 1 a sawslot 6 is arranged which is symmetrical to the longitudinal central plane of the needle shank 1 and which has a needle back punch 7 at the needle shank back 5. A needle latch 8, having a latch shank 9, is pivotally supported in the sawslot 6. The latch shank 9 has an end portion 10 situated in the sawslot 6 and provided with a cylindrical latch bore 11. The needle latch 8 is pivotally supported by a cylindrical bearing element 13 passing through the bore 11 and containing the pivot axis 12. The bearing element 13 may be formed by a single rivet inserted in corresponding bore holes provided in opposite cheeks laterally bounding the sawslot 6 or by two oppositely oriented, axially aligned rivet stubs pressed inwardly from the cheeks. At its end opposite the latch bore 11 the needle latch 8 is provided with a frontal end formed as a spoon 14 which lies on the hook tip 3 in the closed position of the needle latch 8.

In the sawslot 6 a rod-shaped or leaf-shaped straight spring element 15 is arranged which lies with both ends on two shoulders 160 formed in the two mutually opposite end faces of the sawslot 6. The spring element 15 may freely bend towards the shank back 5 as shown, for example, in broken lines in FIG. 3.

Figure 2:
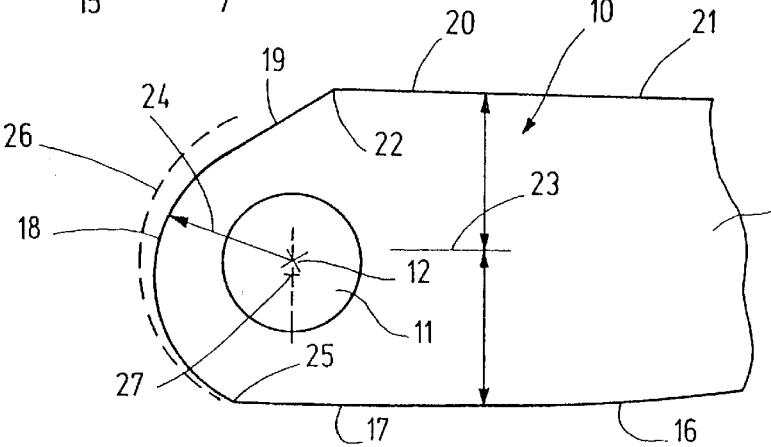
FIG. 2 is an enlarged side elevational detail of the needle latch of FIG. 1.

The end part 10 of the latch shank 9 is formed as a cam element which is supported on the spring element 15. Also referring to FIG. 2, the cam element has a first flat portion 17 situated on the upper side 16 of the latch shank 9. The first flat portion 17 extents (as viewed in a perpendicular projection) to and beyond the pivot axis 12 and is adjoined by an arcuate cam face 18 which, with a smooth transition, is adjoined by a second flat portion 19. The second flat portion 19 and a surface 20 which is situated parallel to the first flat portion 17, intersect at the lower side 21 of the latch shank 9 along transversely extending kink edge 22. The axis 12 of the latch bore 11 is offset with respect to the longitudinal mid plane 23 between the first flat portion 17 and the parallel surface 20 towards the upper side 16 of the latch shank 9. In the alternative, an offset to the lower latch shank side 21 may be provided or it is feasible to dispense with an offset altogether. The arcuate cam face 18 is so configured that its radial distance 24 from the axis 12, starting from a transversely extending kink edge 25 at which the cam face 18 intersects the first flat portion 17, continuously decreases towards the lower side 20 of the latch shank 9. Such a course of the cam face 18 is made visible to the observer by an imaginary dashed circular arc 26 drawn about the axis 12 in FIG. 2.

In the illustrated embodiment the cam face 18 is circularly arcuate. It forms a portion of a cylinder whose axis 27 is offset with respect to the axis 12 of the latch bore 11 by a small amount in the direction of the upper side 16 of the latch shank 9. The cam face 18 thus forms an eccentric surface compared to the wall of the latch bore 11. In the alternative, embodiments are feasible in which the cam face 18 has a different continuous course, for example, a spiral configuration in which case the radius of curvature of the cam face 18 is not constant, but continuously decreases as viewed from the kink edge 25 as a starting position.

During the knitting operation the needle latch 8 pivots between the closed position shown in broken lines in FIG. 3 in which the spoon 14 lies on the hook tip 3 and the rearward position shown in solid lines in FIG. 1. In the rearward position the needle latch 8 either lies on the upper side 4 of the needle shank 1 as shown in FIG. 1, or its upper side 16 is at a small distance from the upper side 4 of the needle shank 1. In the rearward position the needle latch 8 is held in a stable manner by virtue of the fact that its first flat portion 17 lies face-to-face on the spring element 15 and/or the kink edge 25, as viewed in FIG. 2, lies to the left of the pivot axis 12 and defines the rearward position of the needle latch 8. When, during inward motion of the latch needle, the loop gliding on the upper side 4 of the needle shank 1, runs up onto the upper side 16 of the latch shank 9, the needle latch 8, as viewed in FIG. 1, is pivoted counterclockwise out of its rearward position. After overcoming the slight "detent" formed by the kink edge 25, the arcuate cam face 18 runs up onto the spring element 15. Since the cam face 18 is formed as an eccentric surface whose radial distance from the pivot axis 12 is the greatest at the first flat portion 17, the needle latch 8, after overcoming the resistance of the kink edge 25, moves into the forward intermediate position with an increasingly reduced braking effect exerted thereon by the spring element 15.

In the course of the inward motion of the latch needle, during the closing motion of the needle latch 8 controlled by the loop, the radial distance of those zones of the cam face 18 which are in contact with the spring element 15 continuously decreases from the axis 12. As a result, the braking torque applied to the needle latch 8 is increasingly reduced so that the ease of pivotal motion of the needle latch 8 increases until its second flat portion 19 arrives into a face-to-face contact with the spring element 15.

The second flat portion 19 defines the partially open intermediate position of the needle latch 8 shown in solid lines in FIG. 3 and in broken lines in FIG. 1. The flat portion 19 prevents, among others, he needle latch 8 from impacting on the hook tip 3 in an unbraked manner during the closing motion.

As soon as the loop releases the needle latch 8 subsequent to sliding thereon and bringing it from its partially open position into the closed position shown in broken lines in FIG. 3, the needle latch 8 returns into its partially open position which is defined by the second flat portion 19 in cooperation with the spring element 15.

In the course of the outward motion of the latch needle the needle latch 8 is released by the loop. The needle latch 8 pressed against the upper side 4 of the needle shank 1, based on its inherent elasticity and the effect of the spring element 15, first seeks to snap up from its rearward position upon the sudden release and to assume an undefined position until it is again closed by the loop during the inward motion of the latch needle. Such an uncontrolled sudden motion of the needle latch 8 from the rearward position is, however, prevented by virtue of the fact that upon overcoming the resistance of the kink edge 25, the spring element 15 which is biased against the end portion (cam element) 10 of the latch shank 9 exerts a braking effect on the needle latch 8. Thus, the needle latch 8, even if it overcomes the detent effect of the kink edge 25 upon release, is immediately thereafter brought to a standstill (shown in dash-dot lines in FIG. 1) by that region of the cam face 18 which has the large radial distance from the axis 12.

Embodiments are also feasible in which the transversely extending kink edge 25 is dispense with and the arcuate cam face 18 has a continuous transition into the first flat portion 17 or another surface of the upper side 16 of the latch shank 9. It may also be feasible in some instances to omit the second flat portion 19 so that the arcuate cam face 18 adjoins immediately a surface on the lower side 21 of the latch shank 9. Or, the needle latch 8 may be so structured that the kink edge 25 represents the intersection of the cam face 18 and the upper side 16 of the latch shank 9, whereby the first flat portion 17 is dispensed with.

It will be understood that the above description of the present invention is susceptible to various modifications, changes and adaptations, and the same are intended to be comprehended within the meaning and range of equivalents of the appended claims.

What is claimed is:

1. A latch needle for loop-forming textile machines, comprising (a) a needle shank having a length, an upper side, a back and a sawslot; said sawslot extending into said needle shank from said upper side and being oriented parallel to said length;

(b) a hook carried at an end of said needle shank;

(c) a spring element disposed in said sawslot and having at least one end supported by said needle shank; and (d) a needle latch supported in said sawslot for pivotal motion about an axis between a closed position in which said needle latch engages, with a frontal end thereof, said hook and a rearward position; said needle latch having a latch shank including (1) an upper side; in said rearward position said needle latch being situated adjacent said upper side of said needle shank;

(2) a lower side; and (3) an end part formed as a cam being in engagement with said spring element; said cam including (i) a component formed of at least one of a flat portion at said upper side of said latch shank and a kink edge at said upper side of said latch shank; said component, in cooperation with said spring element, determining and maintaining said rearward position of said needle latch; and (ii) an arcuate cam face adjoining said component; a radial distance of said arcuate cam face from said axis gradually decreasing from said upper side of said latch shank towards said lower side thereof.

2. The latch needle as defined in claim 1, wherein said cam face has a substantially spiral course.

3. The latch needle as defined in claim 1, wherein said kink edge extends transversely to a length of said latch shank; said cam face intersecting a surface on said upper side of said latch shank in said kink edge.

4. The latch needle as defined in claim 3, wherein said surface is said flat portion.

5. The latch needle as defined in claim 1, wherein said needle latch has a partially open position between said closed and rearward positions and wherein said flat portion is a first flat portion; further comprising a second flat portion provided on said end part; said second flat portion, in cooperation with said spring element, determining and resiliently maintaining said partially open position of said needle latch.

6. The latch needle as defined in claim 5, wherein said cam face has an essentially smooth transition into said second flat portion.

7. The latch needle as defined in claim 1, wherein said cam face is substantially circularly arcuate and further wherein the center of curvature of said cam face is located at a distance from said axis.

8. The latch needle as defined in claim 7, wherein said cam face is located at a distance from said upper side of said latch shank.

* * * * *

UNITED STATES PATENT AND TRADEMARK OFFICE

CERTIFICATE OF CORRECTION

PATENT NO. : 5,956,976
DATED : September 28, 1999
INVENTOR(S) : Oskar Schaffer et al It is certified that error appears in the above-identified patent and that said Letters Patent is hereby corrected as shown below:

Title page,
Item [73], the name of the assignee should read:
-- Groz-Beckert KG --.

Signed and Sealed this

Twenty-first Day of August, 2001

*Attest:*

Nicholas P. Godici

*Attesting Officer*

NICHOLAS P. GODICI
*Acting Director of the United States Patent and Trademark Office*